United States Patent [19]

Tsunoi et al.

[11] Patent Number: 4,559,687

[45] Date of Patent: Dec. 24, 1985

[54] METHOD OF MANUFACTURING A COMBUSTOR NOZZLE

[75] Inventors: Makato Tsunoi; Toshio Kai; Daisaku Shozen; Tatsuo Morimoto; Ikuo Inoue, all of Hiroshima; Katsuo Jindo; Tetsuya Sato, both of Yokkaichi, all of Japan

[73] Assignee: Mitsubishi Jukogyo Kabushiki Kaisha, Tokyo, Japan

[21] Appl. No.: 631,833

[22] Filed: Jul. 17, 1984

[51] Int. Cl.[4] ..... B21D 53/00

[52] U.S. Cl. ..... 29/157 C; 29/527.6; 29/557; 29/DIG. 5; 29/DIG. 26; 164/95

[58] Field of Search ..... 29/DIG. 26, 157 C, 527.1, 29/527.5, 527.6, 557, DIG. 5; 164/98, 99, 100, 101, 102, 103, 104, 105; 222/566, 575; 431/157, 158

[56] References Cited

U.S. PATENT DOCUMENTS 4,187,595 2/1980 Kuhn, Jr. ..... 29/157 C

FOREIGN PATENT DOCUMENTS 709375 1/1980 U.S.S.R. ..... 29/157 C

*Primary Examiner*—Howard N. Goldberg
*Assistant Examiner*—Ronald S. Wallace
*Attorney, Agent, or Firm*—Wenderoth, Lind & Ponack

[57] ABSTRACT

A method of manufacturing a nozzle for a combustor in, for example, a hydrogen producing plant. A mold is prepared from a material forming a nozzle body, and an alloy forming a covering layer is cast into the mold. The resulting combination of the material and the alloy is machined into a predetermined nozzle shape in which the covering layer covers the nose of the nozzle body.

5 Claims, 4 Drawing Figures

METHOD OF MANUFACTURING A COMBUSTOR NOZZLE

BACKGROUND OF THE INVENTION

1. Field of the Invention

This invention relates to a method of manufacturing a combustor nozzle.

2. Description of the Prior Art

A combustor in, for example, a gasifying plant for producing hydrogen by the partial oxidation of hydrocarbon has a nose covered by a heat resistant alloy, since it is exposed to a high temperature up to, say, 800° C. and liable to wear by gas or dust, or corrosion by impurities in fuel. A typical nose construction is shown in FIG. 1. A nose 1 terminates in a covering layer 2. A nozzle gun 3 is provided for supplying hydrocarbon. The nose 1 and the gun 3 defines therebetween a clearance 4 through which oxygen is supplied for the partial oxidation of the hydrocarbon. The nose 1 is provided with a water cooler 5. The covering layer 2 has hitherto been found by one of the following methods:

A. Welding.

A plurality of layers of, for example, a nickel-based corrosion resistant alloy such as Hastelloy X or a cobalt-based corrosion resistant alloy such as Stellite are welded to the nose and machined appropriately.

B. Spray coating.

A heat resistant ceramic material is spray coated on the tip of the nose.

C.

No such covering layer is provided, but the heat resistance of the nose per se is improved.

These methods have, however, their own drawbacks as will hereinafter be pointed out.

A. Welding.

(1) The nose material melts into the alloy during its welding, and brings about a change in its composition. This brings about a reduction in its mechanical properties and corrosion resistance at a high temperature, and the alloy is, therefore, liable to corrosion at a high temperature or crackng due to fatigue.

(2) The nickel- or cobalt-based alloy is lower in thermal conductivity than the nose material, which is low alloy steel, such as Cr-Mo steel. The covering layer should, therefore, be small in thickness in view of its cooling effect and thermal fatigue resistance. No satisfactorily thin covering layer can be formed by welding, since it is impossible to reduce satisfactorily the thickness of an interfacial diffusion layer between the nose material and the alloy.

(3) The alloy is so likely to melt into the nose material that no clear structural boundary can be obtained between the covering layer and the nose material. It is, therefore, very likely that a crack formed on the surface of the covering layer by corrosion, fatigue or thermal impact may propagate through the nose material.

B. Spray coating.

The ceramics are greatly lower than the nose material and inferior in resistance to thermal impact. It is, therefore, likely that the covering layer may quickly crack and peel off the nose material.

C.

The low alloy steel is lower in hardness at a high temperature than the nickel- or cobalt-based heat resistant alloy. If no covering layer is provided, therefore, the nose is liable to wear by fuel gas or dust.

The nose of a combustor is easily influenced by a temperature change which may result from a change in the supply of fuel and the shape of the flame thereby formed. It is liable to wear or corrosion by the dust in the fuel or the fuel gas itself. Moreover, insofar as it is one of the essential members of an integral plant, it is required to have a certain length of guaranteed life (e.g. six months), since any trouble that it may have between regular inspections or repairs interrupts the operation of the plant and brings about a reduction in production. Under these circumstances, the following characteristics are, among others, required of the nose of the combustor:

(1) High resistance to thermal fatigue and impact;
(2) Good oxidation resistance at a high temperature;
(3) Good resistance to wear and corrosion at a high temperature; and
(4) Stability in the performance of the product. None of the conventional methods for protecting the nose, however, satisfies these requirements.

SUMMARY OF THE INVENTION

It is an object of this invention to provide a method which eliminates the drawbacks of the conventional methods and makes it possible to manufacture a combustor nozzle which satisfies the requirements listed at (1) to (4) above.

This object is attained by a method which essentially comprises casting an alloy forming a covering layer into a mold formed from a material forming a nozzle body, and machining the resulting assembly of the material and the alloy into a predetermined nozzle shape.

The method of this invention provides the following advantages, among others:

(1) A diffusion layer having only a very small thickness of, say, 0.1 mm is formed between the nose material and the covering layer, and neither the nose material nor the covering layer undergoes any substantial change in composition. There is, therefore, no reduction in the heat or corrosion resistance of the covering layer.

(2) The nose material and the covering layer are clearly different from each other in structure; therefore, even if any crack may form in the covering layer, it hardly propagates through the nose material.

(3) The conditions of manufacture are easy to control to ensure the manufacture of a product of high performance at any time.

The method of this invention is applicable to the manufacture of not only the nose of a combustor for a hydrogen producing plant, but also the noses of a variety of other types of combustor nozzles.

DETAILED DESCRIPTION OF THE INVENTION

Figure 1:
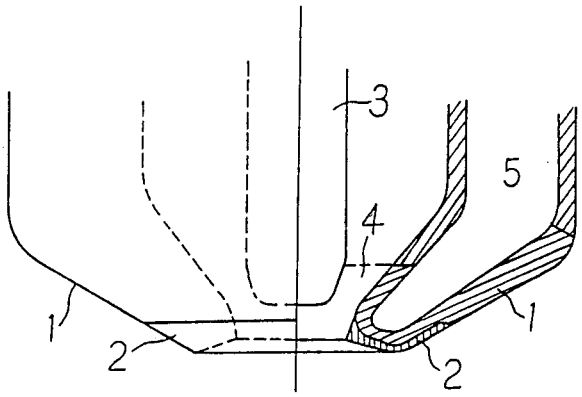
FIG. 1 is a schematic front elevational view, partly in section, of the nose of a conventionally known combustor for a hydrogen producing plant.
Figure 2A:
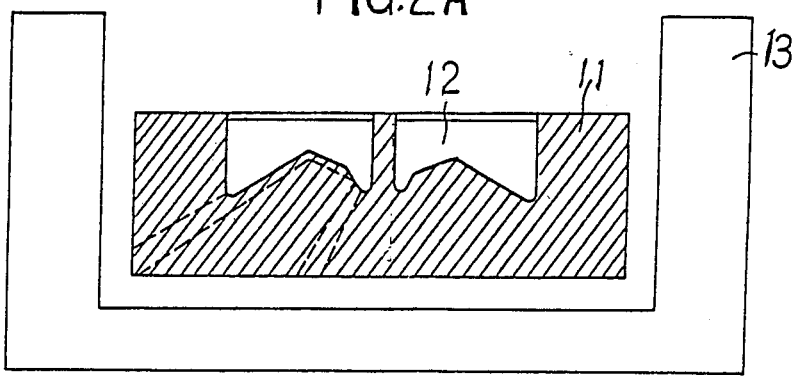
FIGS. 2A to 2C are schematic front elevational views, partly in section, illustrating a method embodying this invention.
Figure 2B:
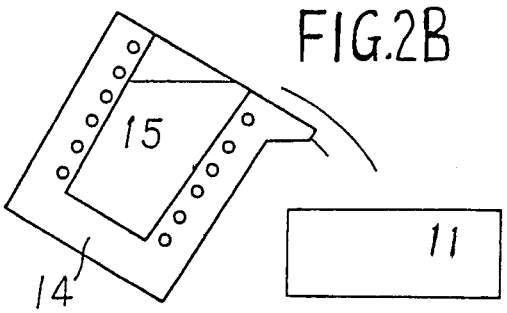
Figure 2C:
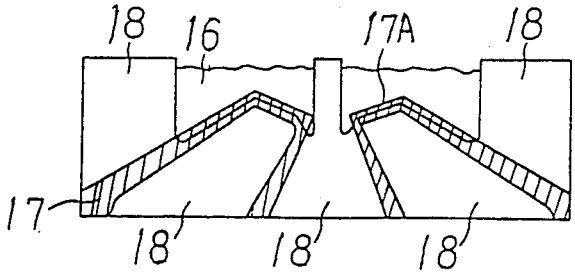

Referring to FIGS. 2A to 2C of the drawings, there are shown a series of steps for manufacturing in accordance with this invention the nose of a combustor for a hydrogen producing plant. A mold 11 is preheated in an electric furnace 13 in the presence of a reducing molten flux 12 which prevents the oxidation of the inner surface of the mold 11, as shown in FIG. 2A. Anhydrous sodium borate may be used as the flux. A heat resistant alloy 15, which is used to form a covering layer, is melted in a high frequency induction furnace 14, and the molten alloy is poured into the mold 11, as shown in FIG. 2B. The mold 11 may be formed from 1.25Cr-0.5Mo steel, and the alloy 15 may be a nickel-based heat resistant alloy. After the alloy 15 has solidified, the assembly of the mold 11 and the alloy 15 is machined into a predetermined shape to yield a product 17 carrying a covering layer 17A composed of the heat resistant alloy, as shown in FIG. 2C. As is obvious therefrom, the product 17 is contained by removing the alloy from an area 16 and the mold material from areas 18.

TABLE 1 compares in chemical composition several noses made by a conventional welding method and several noses made by the method of this invention which is shown in FIGS. 2A to 2C. It is obvious from TABLE 1 that the products of this invention showed a normal range of composition at a distance of only 0.1 mm from the interface between the nose body and the covering layer, while the conventionally welded products showed a change in composition at a depth up to about 2 mm.

TABLE 1

| Distance from interface (mm) | | Composition of the covering alloy (Hastelloy $C_4$) | | |
|---|---|---|---|---|
| | | Cr 14.0/18.0 | Mo 14.0/17.0 | Fe Less than 3.0 |
| 0.05 | Welded product | 3.0 | 4.8 | 67.8 |
| | Product of the invention | 8.4 | 6.8 | 50.3 |
| 0.1 | Welded product | 7.5 | 5.1 | 43.3 |
| | Product of the invention | 14.2 | 15.8 | 3.2 |
| 0.5 | Welded product | 10.9 | 8.9 | 5.4 |
| | Product of the invention | 14.3 | 16.3 | 2.3 |
| 1.0 | Welded product | 12.5 | 14.3 | 3.0 |
| | Product of the invention | 14.8 | 16.1 | 2.4 |
| 2.0 | Welded product | 14.4 | 16.2 | 3.1 |
| | Product of the invention | 14.0 | 16.4 | 2.0 |

The products were also tested for oxidation resistance. The covering layer was partly removed to leave a thickness of 1 mm from the interface, and heated at 1000° C. for 400 hours intermittently on a cycle of 15 hours of heating and five hours of cooling. The products were, then, tested for loss by corrosion. A bare product not having any covering layer was also tested in the same way. The results are shown in TABLE 2. As is obvious therefrom, the product of this invention showed a drastically smaller amount of less by corrosion than the conventional products.

TABLE 2

| | Loss by corrosion ($mg/cm^2$) | | |
|---|---|---|---|
| | 100 h | 200 h | 400 h |
| Conventional products | | | |
| Bare (2.25Cr—1Mo) | −100 | — | — |
| Welded | 0 | 2 | 21 |
| Product of this invention | 0 | 0 | 0 |

The same products were also tested for tensile strength and hradness at a high temperature. The results are shown in TABLE 3. As is obvious therefrom, the welded product showed a drastic reduction in hardness with a rise in temperature, and the bare material also showed a very low degree of hardness at a high temperature. The product of this invention was superior to the conventional products both in tensile strength at a high temperature and in hardness at a high temperature.

TABLE 3

| | Tensile strength at a high temp. ($kg/mm^2$) | | | Hardness at a high temp. | | |
|---|---|---|---|---|---|---|
| | 600° C. | 700° C. | 800° C. | 600° C. | 700° C. | 800° C. |
| Conventional products | | | | | | |
| Bare (2.25 Cr—1Mo) | 30.1 | 15.2 | 6.4 | 130 | 110 | 80 |
| Welded | 45.3 | 29.8 | 10.3 | 180 | 171 | 164 |
| Product of the invention | 47.2 | 40.1 | 36.5 | 190 | 176 | 168 |

What is claimed is:

1. A method of manufacturing a combustor nozzle, which comprises preparing a mold from a material forming a nozzle body, casting an alloy forming a covering layer into said mold, and machining the resulting combination of said material and said alloy into a predetermined nozzle shape in which said covering layer covers the nose of said nozzle body.

2. A method as set forth in claim 1, wherein said material is steel containing 1.25% Cr and 0.5% Mo, while said alloy is selected from the group consisting of nickel- and cobalt-based heat resistant alloys.

3. A method as set forth in claim 2, wherein said alloy in Hastelloy $C_4$.

4. A method as set forth in claim 3, further including preheating said mold in the presence of a reducing flux.

5. A method as set forth in claim 4, wherein said flux is anhydrous sodium borate.

* * * * *